US005639080A

United States Patent [19]

Evans

[11] Patent Number: 5,639,080

[45] Date of Patent: Jun. 17, 1997

[54] SYSTEM FOR HANDLING PURGED SHEETS IN THE OUTPUT OF A PRINTER

[75] Inventor: J. Brian Evans, Fairport, N.Y.

[73] Assignee: Xerox Corporation, Stamford, Conn.

[21] Appl. No.: 548,239

[22] Filed: Oct. 25, 1995

[51] Int. Cl.[6] ..... B65H 39/02

[52] U.S. Cl. ..... 270/58.28; 270/58.31

[58] Field of Search ..... 270/58.31, 58.13, 270/58.28, 58.12, 58.08

[56] References Cited

U.S. PATENT DOCUMENTS

| | | | |
|---|---|---|---|
| 3,466,983 | 9/1969 | Jagenberg | 270/58.31 |
| 4,688,924 | 8/1987 | Anzai et al. | 355/35 H |
| 4,730,822 | 3/1988 | Wagner | 270/58.31 |
| 5,045,881 | 9/1991 | Kinder et al. | 355/206 |
| 5,128,762 | 7/1992 | Muramatsu et al. | 358/296 |
| 5,316,279 | 5/1994 | Corona et al. | 270/1.1 |
| 5,407,081 | 4/1995 | Oshino | 270/58.31 X |
| 5,409,202 | 4/1995 | Naramore et al. | 270/53 |

OTHER PUBLICATIONS

Xerox Disclosure Journal, vol. 19, No. 6, Nov./Dec. 1994 p. 497–"Stack Discriminator" by Howell.

Xerox Disclosure Journal, vol. 18, No. 3, May/Jun. 1993 p. 289–"Process Direction Offsetting of Sheets on a Stack" by B. Parks Xerox Disclosure Journal vol. 19, No. 3, May/Jun., 1994 "Job & User Distinguishing Offset Stacking".

*Primary Examiner*—Hoang Nguyen

[57] ABSTRACT

Printing systems with a printing apparatus outputting plural regular print job set sheets in a process direction typically have a control system and an output system with a stacking tray in which the print job set sheets are stacked. The printing apparatus may also occasionally output, into the same stacking tray, purge sheets for removal, as determined by the control system. Here the output system includes process direction sheet offsetting apparatus controlled by the control system for automatically substantially offsetting the purge sheets in the process direction in the stacking tray relative to the regular print job set sheets, so that the purge sheets are readily visible and graspable for removal from the regular print job set sheets even from within a regular print job set, and are not stapled. The printing apparatus can thus continue to print and output more regular print job set sheets on top of the purge sheets. The output system may also automatically offset regular print job sets relative to one another in a direction laterally of the process direction so as to even more clearly distinguish offset purge sheets from offset regular job sets, which are offset perpendicularly thereto.

3 Claims, 2 Drawing Sheets

SYSTEM FOR HANDLING PURGED SHEETS IN THE OUTPUT OF A PRINTER

Figure 1:
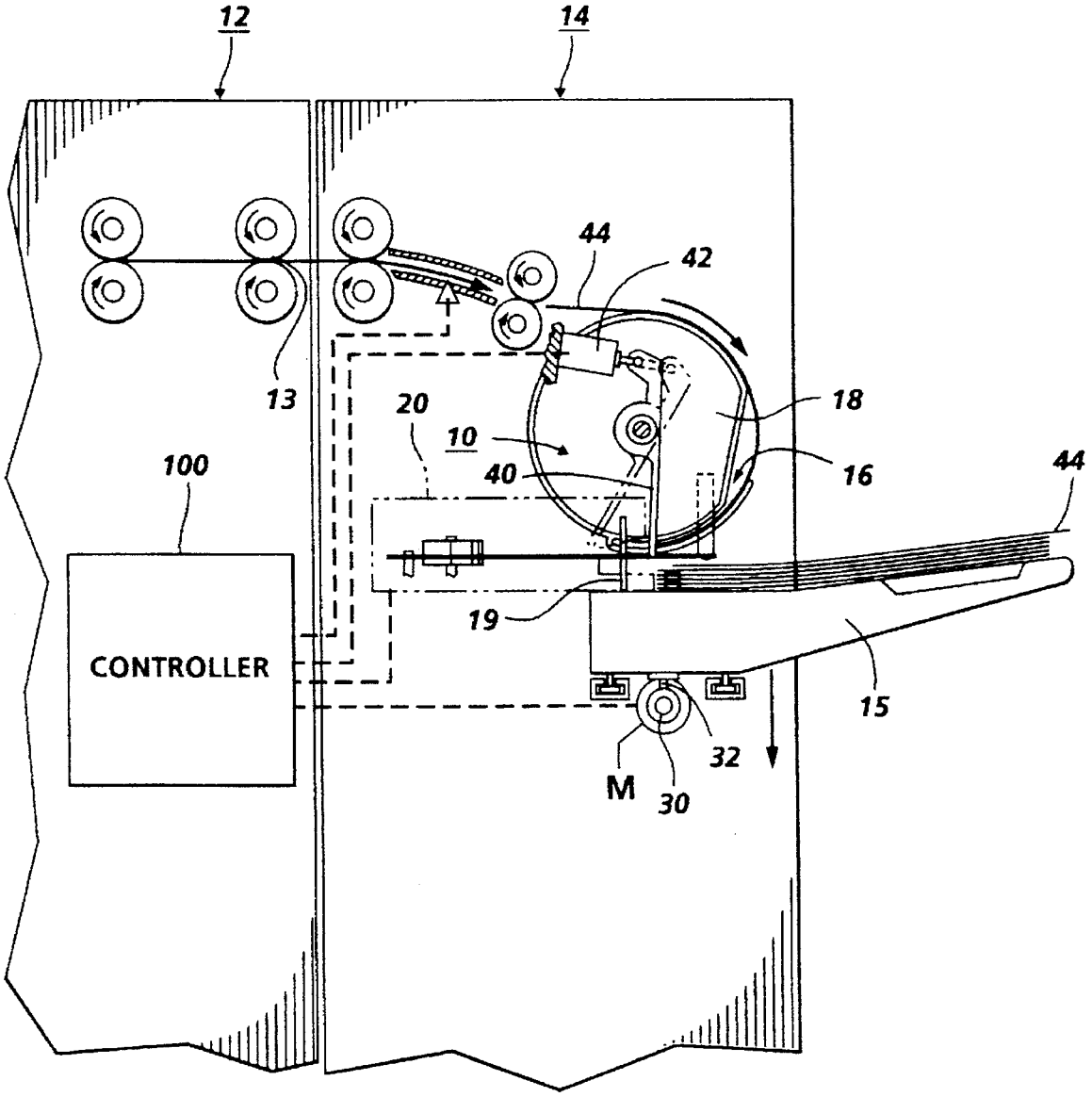

Disclosed is an improved system for segregating purge sheets from regular, desired, printed sheets in a shared output tray, which may be part of a finisher, of a printer, copier or other reproduction apparatus (hereinafter printer). In the disclosed embodiment the purged sheets are substantially offset from the normal printed sheets in the process direction, so as to be readily visible and easily removable for disposal, in contrast to the printed sheets to be retained, without requiring a separate purge tray and its associated paper path and gates.

The disclosed system is an improvement over Xerox Corporation U.S. Pat. No. 5,045,881 issued Sep. 3, 1991 to Carla J. Kinder, et al, entitled "System for Segregating Purged Sheets and Continued Printing". As disclosed there, although those purged sheets can be directed to the same tray as proper printed sheets, printing is not continued if further proper copy sheets will be stacked on top of previously purged sheets in the same tray.

In contrast, in the presently disclosed system, printing may continue or immediately resume after a purge of defective sheets (e.g., sheets printed out of order or with defective images, or located downstream of a jam site). That is, here subsequent properly printed sheets may continue to be printed and placed in the same tray, on top of the purge sheets, since here all the purge sheets extend out from all the rest of the stack of sheets by a substantial distance in the process direction. That is, purge sheets are stacked substantially offset from all the other sheets in the stack. (This is distinguished from banner sheet printing systems which feed out individual specially printed banner sheets for the first or last page of a printed job set in a 90° rotated orientation to other sheets of that job set (one sheet per set), as in Xerox Corporation U.S. Pat. No. 5,316,279 issued May 31, 1994 to Steven C. Corona, et al.)

Mechanisms for offsetting sheets or stacks of sheets in the process direction are known per se, for example U.S. Pat. No. 4,688,924 issued Aug. 25, 1987 to Anzai, et al; U.S. Pat. No. 5,128,762 issued Jul. 7, 1992 to Muramatsu, et al; U.S. Pat. No. 5,409,202 issued Apr. 25, 1992 to Naramore, et al; and Xerox Disclosure Journal publications, Vol. 18, No. 3, May/June, 1993, pages 289–291 to Bruce J. Parks, and Vol. 19, No. 6, November/December, 1994, pages 497–498, to M. L. Howell. The latter shows offsetting in the process direction of the top sheet, one sheet per set, of stacked output sheets. The last three cited references also disclose the use of a disk stacker/inverter system in which process direction offsetting can be provided, and are of interest for suitable such mechanisms which might be modified to be alternatively utilizable for the system embodiment below.

The reasons for purging, and the desirability of providing an output for purged sheets, are discussed in detail in said above-cited U.S. Pat. No. 5,045,881, and other references cited therein, and thus need not be discussed in detail herein. Purging only defective sheets which need to be removed from a print job is much more efficient and environmentally sound than discarding entire completed or incomplete sets. Furthermore, for improved productivity in reproduction apparatus, it is desirable for the machine controller to automatically initiate purging of certain sheets when the controller becomes aware from its inputs and sensors within the paper path and the job input that there are sheets in the paper path of the reproduction apparatus which have not been correctly imaged, or are in the wrong order, or are downstream of a jam site and should be cleared out of the machine to eliminate or reduce tedious operator manual removal of sheets in the paper path of the reproduction apparatus. By automatically purging misprinted or other purge sheets, it is possible to properly reprint the purged sheets and continue the printing operation with minimized printing interruption or down time.

However, it is also desirable to avoid the expense and space of a separate tray and its paper path just for purged sheets. Yet, it is very undesirable to intermix these defective or out of order purged sheets with properly printed sheets, particularly if they are going into a finisher to be bound into sets, since such bound sets or books with defective or out of order sheets would have to be entirely rejected.

Offsetting the purged sheets in the process direction, as here, is particularly desirable for several reasons. First, this means that the purge sheets extend out away from the other sheets in the tray and away from the printing machine and are readily visible and graspable. Furthermore, it is common for output trays, stackers, and finishing systems to provide lateral (transverse) offsetting of print jobs. If purged sheets were laterally offset they might easily be mistaken by the user or operator as just another laterally offset job of regular, acceptable, print sheets. Furthermore, if the purging must occur in the middle of a set of regular sheets, i.e. in the middle of a single continuous collated document, such a laterally positioned purge sheet would mislead the operator into thinking that it was the beginning or end of a print job set, and/or a banner or cover sheet.

The lateral offsetting relative to one another of alternate print job sets, especially discrete collated documents, is well-known, common, and desirable. Examples of lateral sets offsetting in the output of a reproduction apparatus are disclosed for example in said above-cited U.S. Pat. No. 5,409,202; Xerox Corp. U.S. application Ser. No. 08/311,662, filed Sep. 23, 1994 by Frederick A. Green (D/94126); and U.S. Pat. Nos. 4,480,825; 4,712,786; 5,044,625; 5,288,062; 4,188,025; 4,318,539; 4,858,909; 4,861,213; 5,007,625; 5,037,081; and 5,328,169.

In contrast, in the present system, although the sheets to be purged are sent to the same output as good sheets, they are offset only in the process direction when placed on the stack in the output. Thus, purged sheets may be purged even in the middle of a document set, yet are clearly identifiable as purged sheets in contrast to the lateral offsetting between alternate regular print job sets.

A specific feature of the specific embodiment disclosed herein is to provide a printing apparatus having a control system and outputting plural regular print job set sheets in a process direction, said printing system also having an output system with a stacking tray, in which said print job set sheets outputted from said printing apparatus are stacked in said stacking tray, wherein said printing apparatus also occasionally outputs into said same stacking tray purge sheets which are not desired print job set sheets for removal as determined by said control system, the improvement wherein said output system includes process direction sheet offsetting apparatus controlled by said control system for automatically substantially offsetting said purge sheets in said process direction in said stacking tray relative to said regular print job set sheets so that said purge sheets are readily visible and graspable for removal from said regular print job set sheets from within a regular print job set, and wherein said printing apparatus continues to print and output said regular print job set sheets on top of said purge sheets.

Further specific features provided by the specific embodiment disclosed herein, individually or in combination, include those wherein said output system automatically offsets said regular print job sets relative to one another in a direction laterally of said process direction and said offsetting of said purge sheets in said process direction; and/or wherein said output system includes a set stapling system for optionally stapling together the sheets of a said regular print job set along a stapling line, and wherein said purge sheets are offset in the process direction beyond said stapling line so that they are not stapled and may be easily manually removed even from such a stapled regular print job set; and/or wherein said process direction sheet offsetting apparatus comprises a disk stacker with an interactive respositionable sheet edge stop; and/or wherein said output system has a print job set stapling system for stapling a regular print job set, and wherein said process direction sheet offsetting system offsets said purge sheets in said process direction by a sufficient distance to avoid stapling of said purge sheets even within a regular print job set.

As shown in the above-cited and extensive other art, the control of sheet handling systems in printers, here including copiers and other reproduction apparatus, may be accomplished by conventionally actuating them by signals from the copier controller directly or indirectly in response to simple programmed commands and from selected actuation or non-actuation of conventional switch inputs by the operator, such as switches selecting the number of copies to be made in that run, selecting simplex or duplex copying, selecting whether the documents are simplex or duplex, selecting a copy sheet supply tray, etc. The resultant controller signals may through conventional software programing conventionally actuate various conventional electrical solenoid or cam controlled sheet deflector fingers, motors and/or clutches in the selected steps or sequences as programmed. As is also well known in the art, conventional sheet path sensors or switches connected to the controller may be coordinated therewith and utilized for sensing timing and controlling the positions of the sheets in the reproduction apparatus, keeping track of their general positions, counting the number of completed document set copies, detecting misfeeds, jams, out of order sheets, etc. Thus, it is also well known for the controller to determine which sheets should be purged from the printer rather than added to the normal output of good sheets.

In the description herein the term "sheet" refers to a usually flimsy physical sheet of paper, plastic, or other suitable physical substrate for images, whether precut or web fed. A "copy sheet" may be abbreviated as a "copy". A "job" is normally a set of related sheets, usually a collated copy set copied from a set of original document sheets or electronic document page images, from a particular user, or otherwise related.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Figure 2:
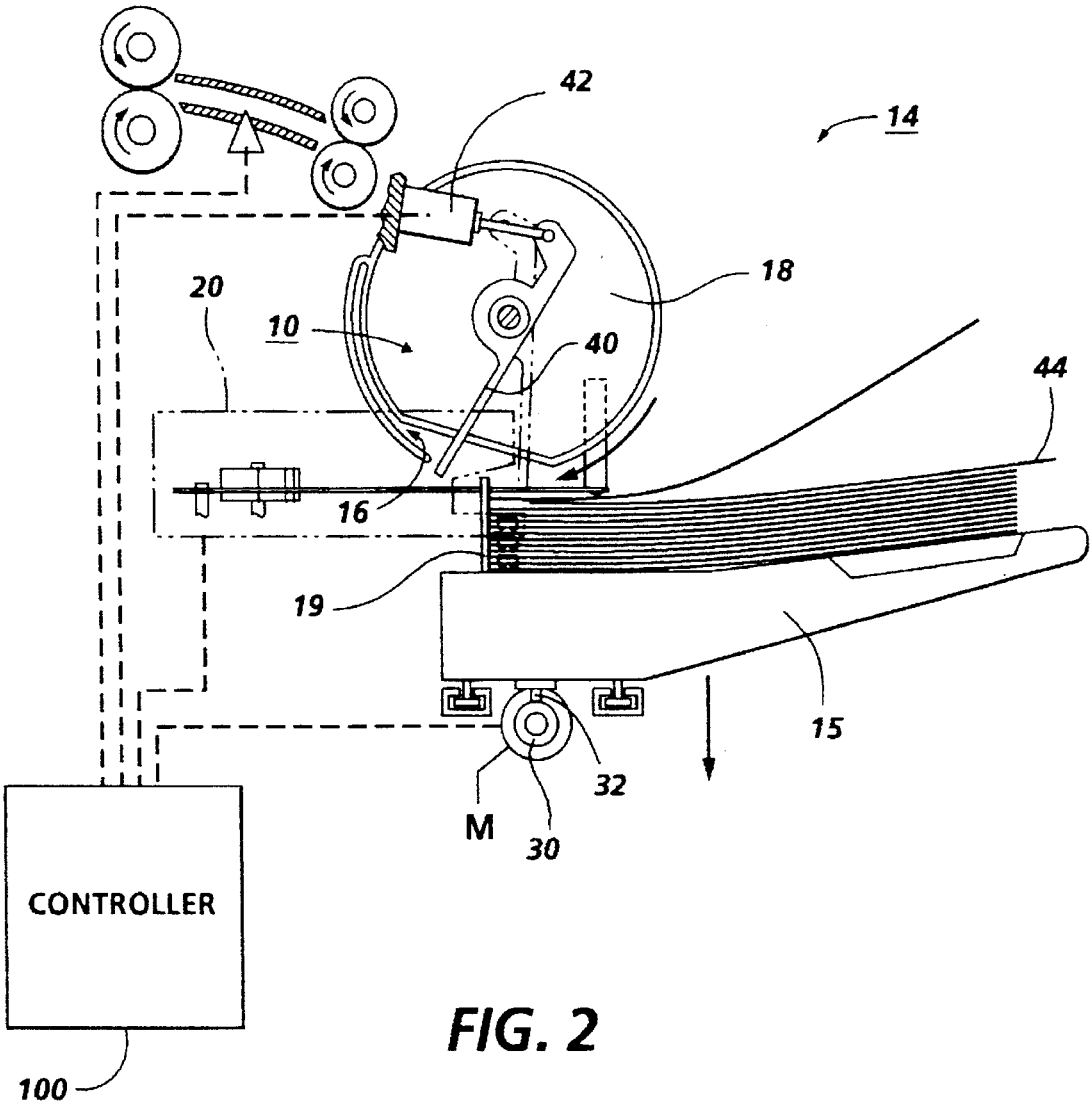
Figure 3:
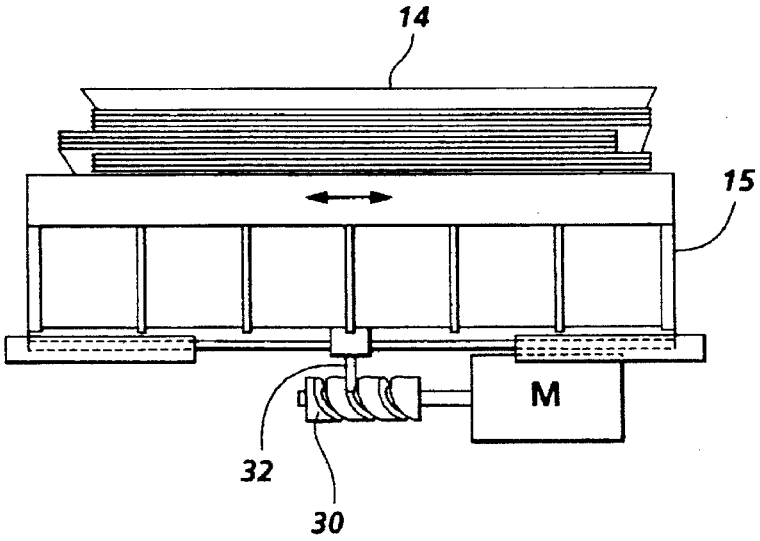

Various of the above-mentioned and further features and advantages will be apparent from the specific apparatus and its operation described in the example below, as well as the claims. Thus, the present invention will be better understood from this description of this embodiment thereof, including the drawing figure (approximately to scale) wherein:

FIG. 1 is a schematic frontal view of one example of a shared output printing system with an output module with one example of the subject system of offsetting, in the process direction, purge sheets separated from good sheets in the same tray, which in this example is part of a disk stacker-inverter-finisher output module;

FIG. 2 is an enlarged view of the interior of the output module of FIG. 1, but showing the subject system for offsetting purge sheets in its inoperative position in solid lines, and its operative position in phantom, in contrast to FIG. 1; and FIG. 3 is a partial end view of the embodiment of FIGS. 1 and 2 showing one example, in the form of a lateral tray reciprocation camming system, of a known lateral (transverse) sets offsetting system which is combined in this example with the subject process direction offsetting of purge sheets.

Referring further to the exemplary purged sheets separating system 10, in FIG. 1, there is schematically shown a printer 12, since almost any known printer and output can incorporate the present system. The regular printer 12 output 13 here is fed directly to an exemplary finishing module 14 with a single stacking tray 15, and the exemplary purged sheets separating system 10 here is part of this exemplary finishing module 14. Here, this exemplary finishing module 14 includes a disk stacker inverter and stapler output, like that of the above-cited U.S. Pat. No. 5,409,202. Normal or good printed sheets may be handled as further described in more detail in that patent. That is, incoming sheets may be acquired one at a time by the slots 16 in the rotating disks 18 and fed around therewith until they reach a normal registration position. This normal process direction registration position is defined here by normally stopping the lead edge of the sheets with fingers 19. Thus, the sheets normally stop there in a stack of sheets for stapling by stapler 20. After a set is stapled it may be pushed out on tray 15 by movement of fingers 19.

Lateral offsetting of the alternate stacks comprising separate or discrete good print jobs sets (not purge sheets) may be as described in that same U.S. Pat. No. 5,409,202, and/or, for example, as shown in FIG. 3. In the known system of FIG. 3 a motor M rotates a grooved barrel cam 30, in which grooves a pin 32 (connected to tray 15) rides, and the tray 15 is conventionally mounted on lateral tracks or runners which allow it to be laterally reciprocated in that manner. The motor M is briefly actuated after the final sheet of each set is outputted and that set is finished and is lying fully on the tray 15, so that the tray 15 is then laterally shifted, and thus the next set will be laterally offset from the prior set, for clear distinction.

Turning now to the exemplary system 10 of process direction (in contrast to said lateral direction) offsetting of purge sheets (only), there is shown in FIG. 1 a pivotable purging arm 40, normally in an inoperative position (illustrated by its dashed line position), but pivotable forward into the slots 16 in the rotating disks 18 (as shown in its solid line position) by electrical actuation of a solenoid 42 by the machine controller 100 signaling the output of a purge sheet or sheets 44. In that operative position, the end of the purging arm 40 stops the lead edge of each purge sheet 44 well before the normal process direction registration and stacking position defined by fingers 19. That is, the operative ends of the actuated purging arm or arms 40 are extended well ahead of the fingers 19, to stop the purge sheet 44 before it can reach the fingers 19, but only when solenoid 42 is actuated by an electrical purge signal from the printer 12 controller 100. Thus, the purge sheet 44 fails out of the rotating disks 18 well ahead of all other sheets and thus sticks out in the process direction from all other sheets in all the stacks, as shown in FIGS. 1 and 2.

It may be seen that the above-described system enables the handling of any purge sheet or sheets, even in the middle of a job set. It offsets the purge sheets in the process direction so that they are readily visible, readily graspable by the operator to remove, and clearly distinguished from the usable or good sheets. This system does not require directing the purged sheets to a separate purge tray nor does it require discarding an entire incomplete set.

It will also be appreciated that the specific process direction or forward offsetting system disclosed herein is merely exemplary and that other process direction offsetting systems may be utilized, such as those disclosed in the above-cited patents thereon, or by momentary speed-up of exit rolls, etc. However, the disclosed system offers advantages over conventional downhill gravity stacking systems in process direction stacking control.

As also described in said above-cited '202 patent, the disclosed output stacking system preferably also includes a stapler 20 for optionally stapling together the sheets of a regular print job set in one or more rear edge positions along a stapling line before that set is fully stacked on the output tray. Desirably, the purge sheets such as 44 are all automatically offset in the process direction by an offset distance such that the inside or rear edges of the purge sheets are stacked out beyond the stapling line, so that the purge sheets are not ever stapled, and thus may be easily manually removed even from such a stapled regular print job set. A less desirable alternative is to inhibit stapling of the print job set in which a purge sheet is stacked.

While this invention has been described in conjunction with a specific embodiment thereof, many alternatives, modifications and variations will be apparent to those skilled in the art. It is intended to embrace all such alternatives, modifications and variations as fall within the true spirit and scope of the following claims.

What is claimed is:

1. In a printing system with a printing apparatus and a control system capable of determining irregular out of order misprinted or other such defective purge sheets desired to be purged, said printing system outputting plural regular print job set sheets in a process direction into an output sheet stacking system having a stacking tray into which said print job set sheets outputted from said printing apparatus are stacked in a normal registration position in said process direction, and wherein said output sheet stacking system includes a set stapling system for stapling together the sheets of a said regular print job set along a stapling line which is transverse said process direction;

the improvement wherein said control system causes said printing apparatus to also occasionally and variably output said purge sheets into said same stacking tray for removal, interposed within said print job sheet sets, and wherein said output system includes a process direction sheet offsetting purging apparatus with an automatic purging operation actuated by said control system to automatically substantially offset only said purge sheets in said process direction in said stacking tray relative to said regular print job set sheets so that said purge sheets are readily visible and graspable for removal from said regular print job set sheets from within a regular print job set, and wherein said purge sheets are purged by being offset in the process direction by said purging apparatus to a position beyond said stapling line so that they are not stapled and may be easily manually removed from said stapled regular print job sets, and wherein said output system has a lateral offsetting system which automatically offsets said regular print job sets relative to one another in a direction laterally of said process direction and perpendicularly to said offsetting of said purge sheets in said process direction; said printing system automatically continuing said printing and stacking of said regular print job sets on top of said purge sheets after said purging of said purge sheets.

2. The printing system of claim 1 wherein said output sheet stacking system comprises a slotted rotating disks stacker with a sheet edge stop system for engaging and registering said regular print job set sheets in said normal registration position in said process direction by removing them from said slotted rotating disks, and said purging apparatus comprises an automatically interposable purging arm system working in combination with said output sheet stacking system to purge said purge sheets out away from said normal registration position of said regular print job set sheets in said process direction.

3. The printing system of claim 2 wherein said purging arm system is automatically interposed in the path of rotation of said slotted rotating disks to strip only purge sheets from said slotted disks substantially prior to said purge sheets being engaged by said sheet edge stop system.

* * * * *